United States Patent [19]

Nishitani et al.

[11] Patent Number: 4,945,874

[45] Date of Patent: Aug. 7, 1990

[54] THROTTLE BODY HAVING INTERCONNECTING LEVER FOR CONVERTING AN OPERATIONAL AMOUNT OF ACCELERATOR TO AN OPENING OF THROTTLE VALVE

[75] Inventors: Tutomu Nishitani; Takio Suzuki; Yasuaki Kono; Tadamasa Osako; Sunao Kitamura; Youzou Sakakibara; Naruto Ito, all of Obu, Japan

[73] Assignee: Aisan Kogyo Kabushiki Kaisha, Obu, Japan

[21] Appl. No.: 286,139

[22] Filed: Dec. 19, 1988

[30] Foreign Application Priority Data

| | | | |
|---|---|---|---|
| Dec. 19, 1987 | [JP] | Japan | 62-193171[U] |
| Dec. 22, 1987 | [JP] | Japan | 62-194205[U] |
| Dec. 22, 1987 | [JP] | Japan | 62-194206[U] |
| Jan. 22, 1988 | [JP] | Japan | 63-7548[U] |
| Jan. 27, 1988 | [JP] | Japan | 63-9210[U] |
| Oct. 15, 1988 | [JP] | Japan | 63-134967[U] |
| Dec. 3, 1988 | [JP] | Japan | 63-157743[U] |

[51] Int. Cl.[5] ..... F02D 9/02

[52] U.S. Cl. ..... 123/400; 261/65; 251/279; 251/289; 251/295

[58] Field of Search ..... 123/400, 403; 74/513, 74/96; 251/289, 295, 279; 261/65

[56] References Cited

U.S. PATENT DOCUMENTS

| | | | |
|---|---|---|---|
| 3,698,372 | 10/1972 | Eshelman et al. | 123/198 |
| 4,411,845 | 10/1983 | Tanahashi et al. | 261/65 |
| 4,450,807 | 5/1984 | Kinoshita et al. | 123/403 |
| 4,476,068 | 10/1984 | Griffin et al. | 261/65 |
| 4,616,518 | 10/1986 | Nüsser | 74/96 |
| 4,782,805 | 11/1988 | Kawano et al. | 123/403 |

FOREIGN PATENT DOCUMENTS

| | | |
|---|---|---|
| 53537 | 11/1986 | Japan . |
| 53538 | 11/1986 | Japan . |

*Primary Examiner*—Tony M. Argenbright
*Assistant Examiner*—Robert E. Mates
*Attorney, Agent, or Firm*—Dennison, Meserole, Pollack & Scheiner

[57] ABSTRACT

A throttle body for an internal combustion engine, comprising a suction passage for supplying a suction air to the internal combustion engine; a throttle valve provided in the suction passage and fixed to a rotatable throttle valve shaft so as to adjust a quantity of the suction air; an interconnecting lever rotatably mounted to an interconnecting shaft and adapted to be rotated by pulling an accelerator cable; a throttle valve operating lever mechanically connected to the interconnecting lever and fixed to the throttle valve shaft, the throttle valve operating lever being rotated in predetermined relational association with rotation of the interconnecting lever to open and close the throtle valve; and a tension spring for normally biasing the throttle valve in a valve closing direction, the tension spring having one end or pivotal point fixed to a part fixed to the throttle body and the other end or operation point fixed to the throttle valve operating lever; wherein the pivotal point and the operation point are located at positions such that a distance from the throttle valve shaft to a line connecting the pivotal point and the operation point is gradually reduced as the throttle valve is opened, and a connection point between the interconnecting lever and the throttle valve operating lever is approached to a line connecting the throttle valve shaft and the interconnecting shaft as the throttle valve is opened.

7 Claims, 22 Drawing Sheets

THROTTLE BODY HAVING INTERCONNECTING LEVER FOR CONVERTING AN OPERATIONAL AMOUNT OF ACCELERATOR TO AN OPENING OF THROTTLE VALVE

BACKGROUND OF THE INVENTION

The present invention relates to an improvement in a throttle body for adjusting a quantity of suction air to be supplied to an internal combustion engine. The throttle body of the present invention includes a suction passage and a throttle valve adapted to be rotated in the suction passage to open and close the same. When a rotational angle or opening of the throttle valve is adjusted, an effective sectional area in the suction passage at the throttle valve is varied to adjust a quantity of suction air.

Normally, the opening of the throttle valve is adjusted by adjusting an operational amount of an accelerator pedal, accelerator lever, etc. (which will be hereinafter also referred to as an accelerator). The present invention relates particularly to a throttle body having an interconnecting lever for converting the operational amount of the accelerator to the opening of the throttle valve, and more particularly to a throttle body utilizing a cam and a cam follower for converting the rotation of the interconnecting lever to the rotation of a throttle valve shaft.

This type of throttle body is disclosed in Japanese Patent Publication Nos. 61-53536, 61-53537 and 61-53538, for example.

In the conventional throttle body, as the operational amount of the accelerator is converted into the opening of the throttle valve by the operation of the interconnecting lever, the relation between the operational amount of the accelerator and the opening of the throttle valve may be considerably freely set by suitably designing a shape of the cam. For example, FIG. 5 shows the relation between a percentage of an actual stroke of the accelerator to an overall stroke thereof or an opening rate of the interconnecting shaft (a rotating shaft for the interconnecting lever) and an opening rate of the throttle valve shaft. Referring to FIG. 5, a straight line X shows the relation in the case that the accelerator is directly connected to the throttle valve without using the interconnecting lever, while a curved line Y shows the relation in the case that the interconnecting lever is used. As apparent from FIG. 5, when the interconnecting lever is not used, the opening of the throttle valve is proportional to the operational amount of the accelerator. To the contrary, when the interconnecting lever is used, a change in the opening of the throttle valve in a certain range of the small opening is relatively dull, while the change in a certain range of the large opening is relatively sharp. According to the relation of the curved line Y, fine adjustment of the opening of the throttle valve may be easily carried out when the opening is in the relatively small range, and the opening in the relatively large range may be made sharply responsive to the operation of the accelerator.

Thus, the throttle body using the interconnecting lever has the above-mentioned advantages, however, it yet has the following problems.

Although the relation between the operational amount of the accelerator and the opening of the throttle valve in the conventional throttle body using the interconnecting lever is satisfactory, there is a problem in an operational force required for operating the accelerator. For example, FIG. 4 shows the relation between the opening of the interconnecting lever and the operational force of the interconnecting shaft. Referring to FIG. 4, a dotted line E, F shows the relation in the prior art (the line E corresponds to a stroke of opening the throttle valve, and the line F corresponds to a stroke of closing the throttle valve), while a solid line G, H shows the relation according to the present invention. As apparent from FIG. 4, the prior art device has a problem such that the operational force is rapidly changed during the stroke, imparting a kind of unnatural feeling to an operator.

Further, the prior art device has another problem such that there is generated an undue frictional force at a contact point between the cam and the cam follower, causing hindrance of smooth accelerator operation.

Additionally, in the prior art device, it is difficult to desirably adjust a relative position of the cam and the cam follower, resulting in dispersion of characteristics of each throttle body as manufactured.

SUMMARY OF THE INVENTION

Accordingly, it is a first object of the present invention to provide a throttle body which may prevent a rapid change in operational force of the accelerator and eliminate an unnatural feeling to an operator.

It is a second object of the present invention to provide a throttle body which may achieve smooth operation of the accelerator.

It is a third object of the present invention to provide a throttle body which may easily compensate a tolerance in manufacturing and prevent wide variation of the relation between an opening of the throttle valve and an operational amount of the accelerator.

The first object is achieved by designing a spring for normally biasing the throttle valve in a valve closing direction.

According to a first aspect of the present invention, (1) a tension spring is used as the above-mentioned spring, and the tension spring is mounted at a position such that a distance from the interconnecting shaft or the throttle valve shaft to the tension spring, that is, a length of a perpendicular from the shaft to the tension spring is reduced as the throttle valve is opened. (2) Furthermore, a cam and a cam follower are provided on either of the interconnecting shaft or the throttle valve shaft and on the other, respectively, and the cam follower is rotated on one side of a line connecting the interconnecting shaft and the throttle valve shaft, and is approached to the line as the throttle valve is opened.

According to the above construction (1), a rotational moment to be created by the tension spring about the interconnecting shaft or the throttle valve shaft is prevented from being widely changed since a change in spring force and a change in effective distance are compensated with each other. According to the above construction (2), a cam shape may be made relatively linear, and the generation of a force hindering the accelerator operation at the contact point between the cam and the cam follower may be greatly prevented. Thus, the operational force of the accelerator may be smoothly changed over the entire stroke.

In a second aspect of the present invention, a spiral spring is used as the aforementioned spring. The spiral spring has a substantially constant resilient force irrespective of its deformation. Therefore, the operational force may be made substantially constant during the operational stroke.

The second object of the present invention is achieved by making a cross section of the cam into a convex shape. With this structure, a force hindering the relative movement of the cam and the cam follower may be reduced to thereby obtain smooth operation of the cam and the cam follower.

The third object of the present invention is achieved by constructing a mounting member of the cam follower in such a manner that an axis of a mounting portion thereof to be mounted to the interconnecting shaft side is eccentric from an axis of a shaft portion on which the cam follower is mounted. With this structure, a relative position between the cam and the cam follower may be finely adjusted by suitably rotating the mounting member. Accordingly, even when there exists a tolerance in manufacturing each part, the relation between the operational amount of the accelerator and the opening of the throttle valve is prevented from being widely varied.

According to a third aspect of the present invention, the interconnecting lever is separated into a first interconnecting lever and a second interconnecting lever. The operation of the first interconnecting lever is followed by the operation of the second interconnecting lever. However, the second interconnecting lever only is operated by the operation of the auto speed control mechanism. With this arrangement, the throttle opening may be manually adjusted through the first and second interconnecting lever by the operation of the accelerator, while when the auto speed control mechanism is operated, the throttle opening may be automatically controlled through the second interconnecting lever. At this time, the operation of the auto speed control mechanism is not transmitted to the accelerator pedal or the like, and the control accuracy of the throttle opening may be suitably adjusted.

The invention will be more fully understood from the following detailed description and appended claims when taken with the drawings.

DETAILED DESCRIPTION OF THE PREFERRED EMBODIMENTS

Figure 1:
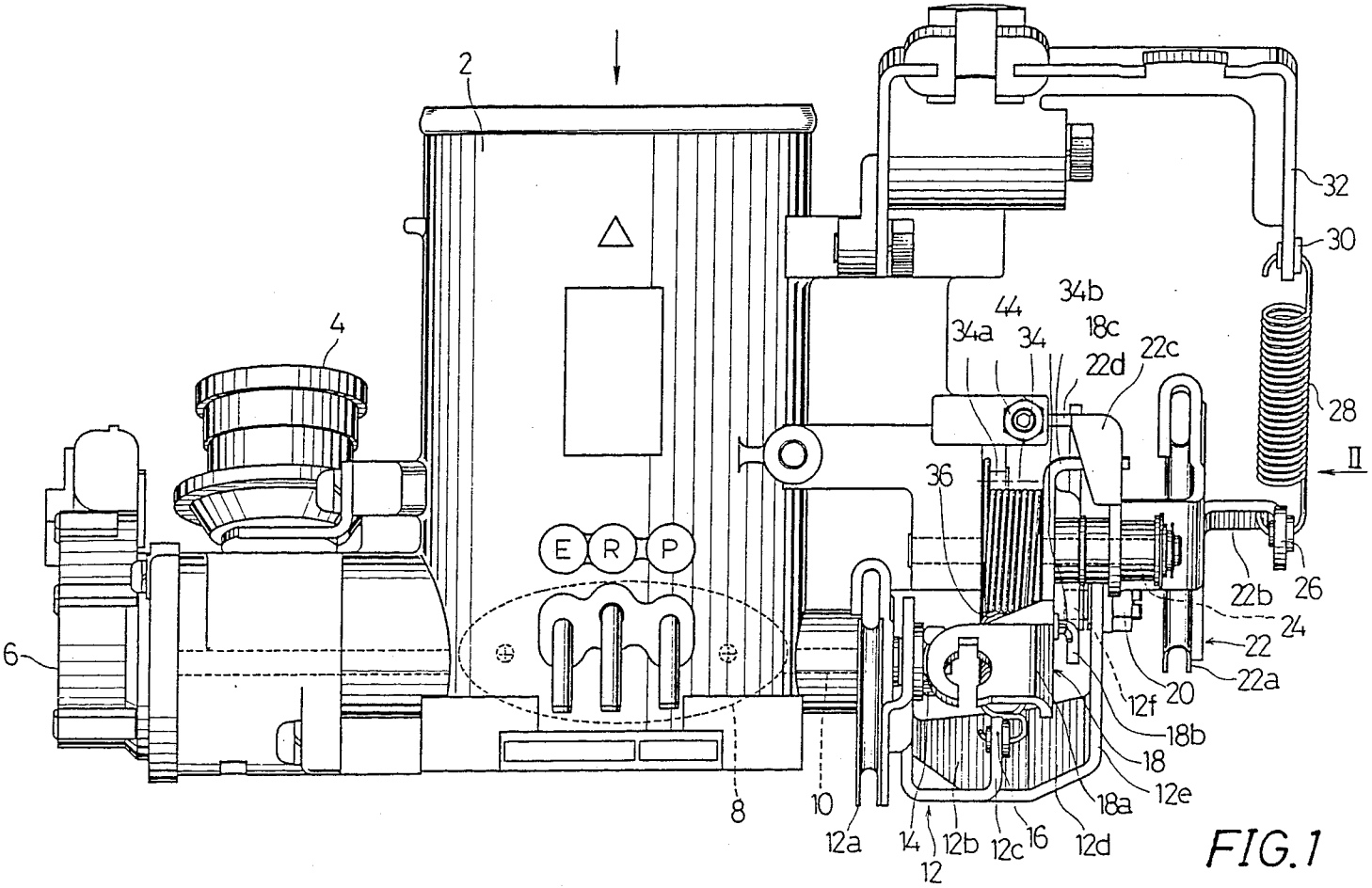
FIG. 1 is a plan view of the throttle body of a first preferred embodiment according to the present invention.
Figure 2:
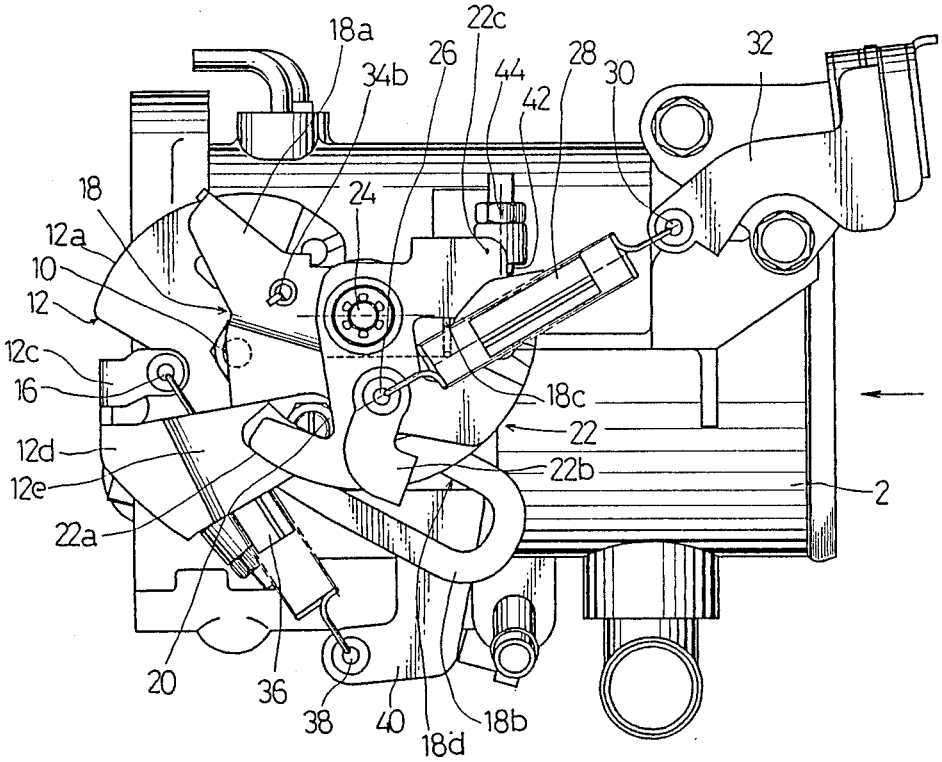
FIG. 2 is a side view taken from the arrow II in FIG. 1.

Referring now to FIGS. 1 and 2, reference numeral 2 designates a suction cylinder having a circular cross section for allowing flow of suction air in a direction, of arrow. A throttle valve shaft 10 is provided to pass through the suction cylinder 2, and a throttle valve 8 is fixed to the throttle valve shaft 10. The throttle valve 8 has a substantially disc-like shape, and it is adapted to rotate with the throttle valve shaft 10 to open and close a suction passage defined in the suction cylinder 2.

Reference numeral 6 designates a throttle sensor for detecting a rotational angle of the throttle valve shaft 10 and converting the same into an electrical signal to be outputted. A dash pot 4 is provided to prevent rapid closing of the throttle valve 8 causing power down of an internal combustion engine.

Reference numeral 22 designates a first interconnecting lever rotatably mounted to an interconnecting shaft 24 fixed to the suction cylinder 2. The first interconnecting lever 22 is integrally formed with an arcuate accelerator cable connecting portion **22*a* for connecting an accelerator cable (not shown), a first arm 22*b*, a second arm 22*c* and an engaging portion 22*d* extending from the second arm 22*c*. A tension spring (first spring) 28 is engaged at its one end (operation point) 26 with the first arm 22*b*, and is engaged at the other end (pivotal point) 30 with a bracket 32 fixed to the suction cylinder 2. The tension spring 28 normally biases the first interconnecting lever 22 in the counterclockwise direction as viewed in FIG. 2. When the first interconnecting lever 22 is rotated in the counterclockwise direction, the throttle valve 8 is rotated in a valve closing direction. A stopper 42 is fixed by a nut 44 through a bracket to the suction cylinder 2. When the accelerator cable is not pulled, the engaging portion 22*d* of the first interconnecting lever 22 engages the stopper 42 to limit further rotation of the lever 22 in the counterclockwise direction. At this time, the throttle valve 8 is so adjusted as to fully close the suction passage by fastening the nut 44, thus obtaining a full closed condition as shown in FIG. 2**.

A second interconnecting lever 18 independent of the first interconnecting lever 22 is rotatably mounted to the interconnecting shaft 24. The second interconnecting lever 18 is integrally formed with an auto speed connecting portion **18*a*, a cam plate portion 18*b*, and an engaging portion 18*c*. The cam plate portion 18*b* has a central cutout portion to form a cam surface 18*d*. A coil spring (second spring) 34 is mounted to the interconnecting shaft 24, wherein one end (pivotal point) 34*a* of the coil spring 34 is fixed to the suction cylinder 2, and the other end (operation point) 34*b* of the coil spring 34 is engaged with the second interconnecting lever 18. The coil spring 34 normally biases the second interconnecting lever 18 in the counterclockwise direction as viewed in FIG. 2**.

The second arm **22*c* of the first interconnecting lever 22 normally engages the engaging portion 18*c* of the second interconnecting lever 18. That is, as shown in FIG. 2, the second arm 22*c* of the first interconnecting lever 22 is located over the engaging portion 18*c* of the second interconnecting lever 18, and the second interconnecting lever 18 is normally biased by the second spring 34 in the counterclockwise direction. Therefore, the second arm 22*c* is normally engaged with the engaging portion 18*c*. Accordingly, when the first interconnecting lever 22 is pulled by the accelerator cable to be rotated in the clockwise direction as viewed in FIG. 2, the second interconnecting lever 18 is also rotated in the clockwise direction by the engagement between the second arm 22*c* and the engaging portion 18*c*. When the accelerator cable is released, the first interconnecting lever 22 and the second interconnecting lever 18 are rotated in the counterclockwise direction by the first spring 28 and the second spring 34, respectively. However, when a clockwise torque is directly applied to the second interconnecting lever 18, the lever 18 only is rotated clockwise, and the first interconnecting lever 22 is not rotated since the second arm 22*c* is located on the counterclockwise side of the engaging portion 18*c***.

The auto speed connecting portion **18*a* of the second interconnecting lever 18 connects a cable (not shown) extending from an auto speed control mechanism, and the second interconnecting lever 18 is rotated clockwise by the operation of the auto speed control mechanism. At this time, the first interconnecting lever 22** is not rotated as mentioned above to prevent transmission of the operation of the auto speed control mechanism to the accelerator cable. Accordingly, the operation of the auto speed control mechanism has no influence upon the accelerator cable and the accelerator pedal, thereby preventing unnatural feeling to an operator.

As previously mentioned, the cam plate portion **18*b* of the second interconnecting lever 18 is formed with the cam surface 18*d*. The cam surface 18*d* is engaged with a roller 12*f*** which will be hereinafter described.

A throttle valve operating lever 12 is relatively irrotationally fixed by a nut 14 to the throttle valve shaft 10. The throttle valve operating lever 12 includes a cable pulling portion **12*a*, a first arm 12*b*, a second arm 12*c*, a third arm 12*d*, a fourth arm 12*e* and the roller 12*f* rotatably mounted to the fourth arm 12*e***.

The roller **12*f* is rotatably mounted to the fourth arm 12*e* by a nut 20, and is engaged with the cam surface 18*d* of the second interconnecting lever 18. When the second interconnecting lever 18 is rotated clockwise as viewed in FIG. 2, the roller 12*f* is also rotated clockwise about the throttle valve shaft 10. As a result, the throttle valve operating lever 12, the throttle valve shaft 10 and the throttle valve 8** are also rotated clockwise to thereby open the suction passage.

A tension spring (third spring) 36 is mounted to the throttle valve operating lever 12. That is, one end (operation point) 16 of the tension spring 36 is engaged with the second arm **12*c* of the throttle valve operating lever 12, and the other end (pivotal point) 38 of the tension spring 36 is engaged with a bracket 40 fixed to the suction cylinder 2. The throttle valve operating lever 12 is normally biased by the third spring 36** in the counterclockwise direction (throttle valve closing direction).

In the suction cylinder device as constructed above, when no pulling force is applied to the accelerator cable, the first interconnecting lever 22 is rotated counterclockwise by the first spring 28 to engage the engaging portion **22*d* with the stopper 42, while the second interconnecting lever 18 is rotated counterclockwise by the second spring 34 to engage the engaging portion 18*c* with the second arm 22*c*. The throttle valve operating lever 12 is rotated counterclockwise by the third spring 36 to engage the roller 12*f* with the cam surface 18*d*, thus establishing the full closed condition of the throttle valve 8 as shown in FIG. 2**.

When the accelerator cable is pulled, the first interconnecting lever 22 is rotated clockwise, the engaging portion **18*c* is urged by the second arm 22*c* to rotate the second interconnecting lever 18 clockwise. At this time, the throttle valve operating lever 12 is also rotated clockwise by the engagement between the roller 12*f* and the cam surface 18*d*, thereby opening the throttle valve 8**.

Figure 3:
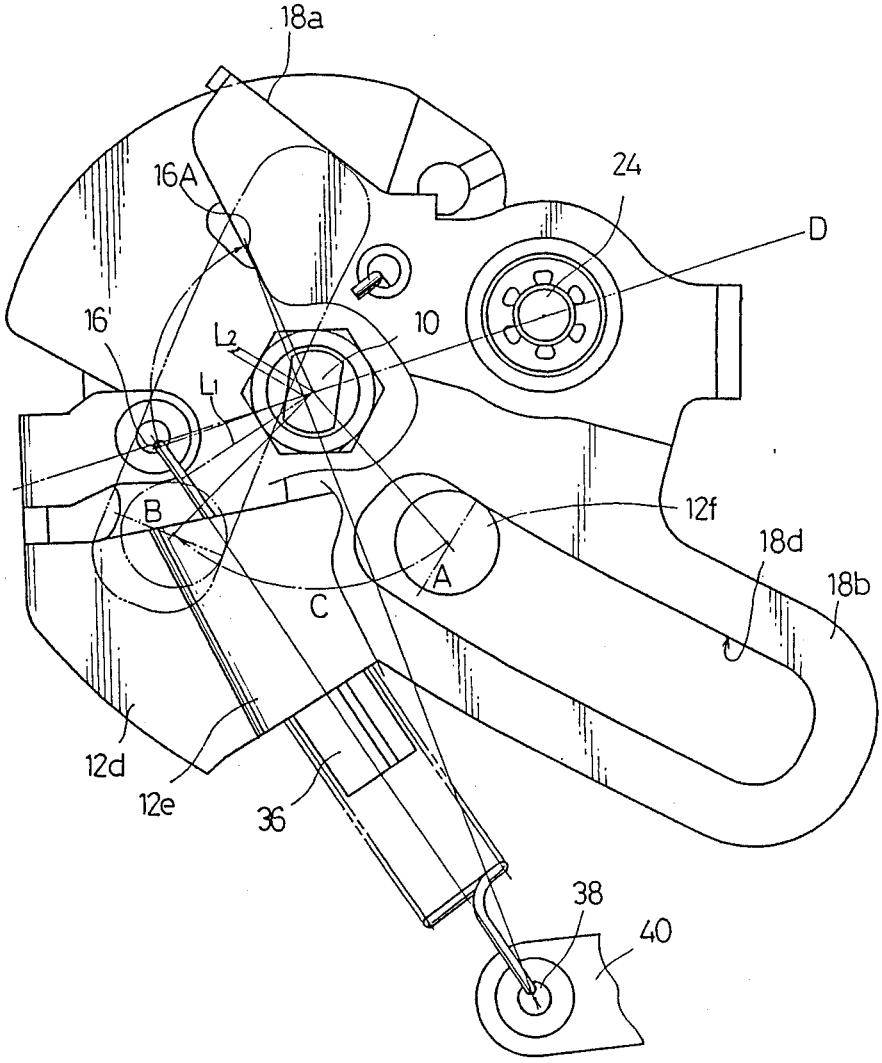
FIG. 3 is an enlarged view of FIG. 2 with the first interconnecting lever and the nut removed.

FIG. 3 shows a relative positional relation among the interconnecting shaft 24, the throttle valve shaft 10, the cam surface **18*d* and the roller 12*f*. For better understanding, the first interconnecting lever 22 and the nut 20 are not shown in FIG. 3. A rotational position of the roller 12*f* and the cam surface 18*d* under the full closed condition of the throttle valve 8** is shown by a solid line, and the rotational position under the full open condition is shown by a chain line.

As shown in FIG. 3, a perpendicular A or B at a contact point of the roller 12f with the cam surface 18d is normally directed outward of a locus C of the roller 12f. Accordingly, during an opening stoke of the throttle valve 8, the roller 12f is smoothly rolled on the cam surface 18d outwardly, thereby generally reducing an operating force and avoiding sudden change of the operation during the stroke. Further, during the opening stroke of the throttle valve 8, the contact point of the roller 12f with the cam surface 18d is normally located on one side of a line D connecting the interconnecting shaft 24 with the throttle valve shaft 10, thereby permitting smooth rolling of the roller 12f on the cam surface 18d. The contact point of the roller 12f with the cam surface 18d is located in such a manner that it is the farthest from the line D under the full closed condition, and it approaches to the line D as closing the throttle valve 8, and it is the nearest to the line D under the full open condition.

Figure 10:
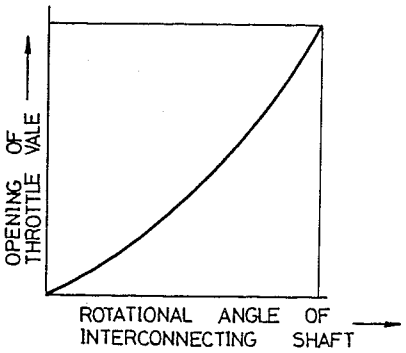
FIG. 10 is a graph of non-linear characteristic between a rotational angle of the interconnecting shaft and an opening of the throttle valve.

FIGS. 6 to 9 show schematic illustrations of the relation between the cam shape and the locus of the roller for attaining the non-linear characteristic shown in FIG. 10.

Figure 6:
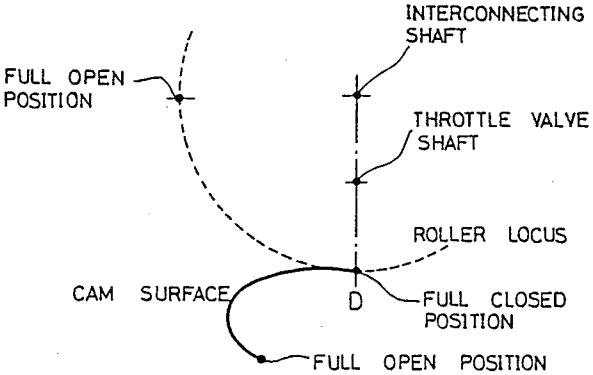

As shown in FIG. 6, the roller is located on the interconnecting lever side, and the cam is located on the throttle valve operating lever side. The roller (connecting point between the interconnecting lever and the throttle valve operating lever) is moved away from the line D as opening the throttle valve 8.

Figure 7:
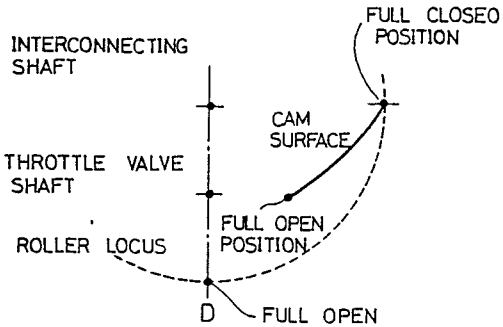
FIGS. 6 to 9 are schematic illustrations of the relation between a cam shaft and a roller locus.

FIG. 7 shows the relation under the condition where the roller is approached to the line D as opening the throttle valve 8, provided that the roller is located on the interconnecting lever side, and the cam is located on the throttle valve operating side.

Figure 8:
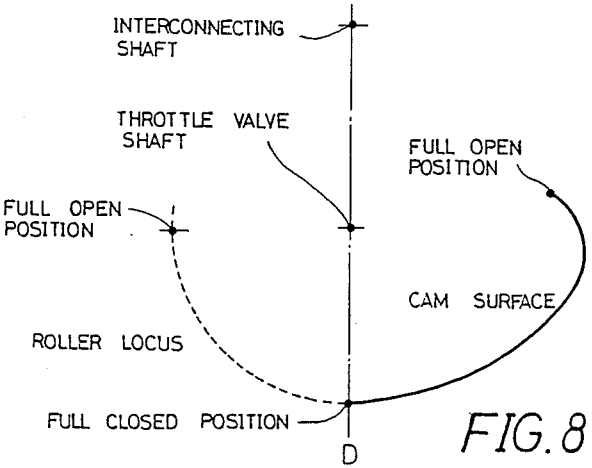

FIG. 8 shows the relation under the condition where the roller is moved away from the line D as opening the throttle valve 8, provided that the cam is located on the interconnecting lever side, and the roller is located on the throttle valve operating lever side.

Figure 9:
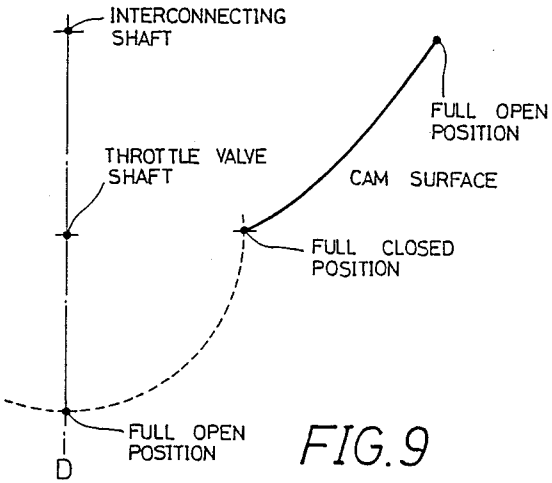

FIG. 9 shows the relation under the condition where the roller is approached to the line D as opening the throttle valve 8, provided that the cam is located on the interconnecting lever side, and the roller is located on the throttle valve operating lever side.

As apparent from FIGS. 7 and 9, the cam shape is rendered relatively linear, while as apparent from FIGS. 6 and 8, the cam shape is rendered widely curved.

In the case shown in FIGS. 6 and 8, a frictional force between the cam and the roller is so applied as to return the throttle valve to the full closed position, causing an increase in throttle valve opening force to be required. Further, the opening force is fluctuated relatively widely during the opening stroke of the throttle valve. To the contrary, in the case shown in FIGS. 7 and 9, the relative movement of the cam and the roller is smoothened to thereby render the throttle valve opening force relatively small and suppressing the fluctuation of the opening force during the opening stroke of the throttle valve.

Referring to FIG. 3, reference numerals 16 and 16A designate the operation points of the third spring 36 under the full closed condition and the full open condition, respectively. Reference character L designates a length of a perpendicular from the throttle valve shaft 10 to a line connecting the operation point 16 and the pivotal point 38. Especially, reference characters L1 and L2 designate the lengths of the perpendiculars under the full closed condition and the full open condition, respectively. As apparent from FIG. 3, the length L is set in such a manner that the length L1 under the full closed condition is gradually reduced as opening the throttle valve until the minimum length L2 under the full open condition.

A rotational moment applied to the throttle valve operating lever 12 by the third spring 36 is obtained from a multiplication of the biasing force of the third spring 36 by the length L of the perpendicular. As apparent from FIG. 3, the biasing force of the third spring 36 increases as opening the throttle valve 8, while the length L of the perpendicular decreases as opening the throttle valve 8. As a result, the rotational moment is not changed so largely irrespective of opening of the throttle valve.

Figure 4:
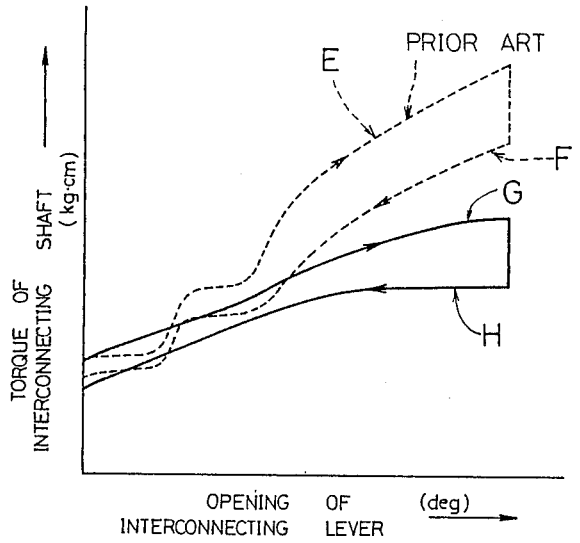
FIG. 4 is a graph showing the relation between an opening of the throttle valve and an opening of the interconnecting lever in the first preferred embodiment and the prior art.

FIG. 4 shows the relation between the opening of the throttle valve and the operating force required for opening and closing the throttle valve in the preferred embodiment (solid line) in comparison with the prior art (dotted line). As apparent from FIG. 4, sudden change in the operating force in the preferred embodiment does not occur, while it occurs in the prior art.

Figure 5:
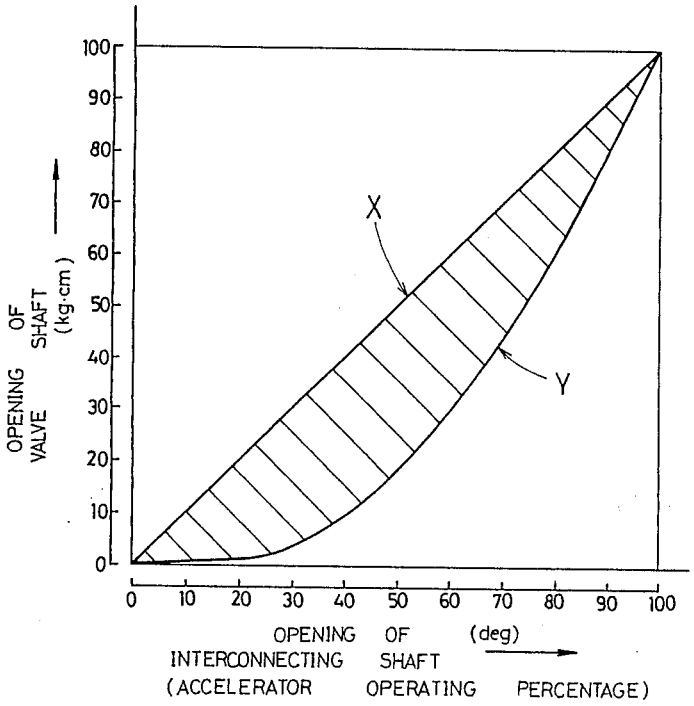
FIG. 5 is a graph showing the relation between an operational degree of the accelerator and an opening of the throttle valve shaft.

FIG. 5 shows the relation between the opening of the interconnecting lever and the opening of the throttle valve in the preferred embodiment, wherein a hatched area indicates a permissible area satisfying the conditions that the contact point between the cam surface and the roller is located on one side of the line D connecting the throttle valve shaft and the interconnecting shaft, and that the roller is approached to the line D as opening the throttle valve.

As apparent from FIG. 5, when the opening of the throttle valve is small, the opening of the interconnecting lever is less varied (which means that fine adjustment of the opening of the throttle valve can be easy). On the other hand, when the opening of the throttle valve becomes large, small rotation of the interconnecting lever makes large variation of the opening of the throttle valve. Thus, the non-linear characteristic between the openings of the throttle valve and the interconnecting lever can, be established.

In the preferred embodiment, the curvature of the cam surface can be made relatively linear as compared with the prior art, thereby reducing an area of the cam surface.

Similar to the third spring 36, a rotational moment to be applied to the first interconnecting lever is less changed in connection with the first spring 28. That is, a length of a perpendicular from the interconnecting shaft 24 to a line connecting the operation point 26 of the first spring 28 to the pivotal point 30 is maximum under the full closed condition, and it is gradually reduced until the full open condition.

As described above, the preferred embodiment has achieved the non-linear characteristic and the gradual change of the valve operating force.

The operation from the auto speed control mechanism through the cable is transmitted through the mechanical connection between the cam and the roller to be converted into an opening of the throttle valve. Therefore, the opening of the throttle valve can be finely adjusted in a small opening range thereof by the auto speed control mechanism. Further, as the interconnecting lever is separated into the first interconnecting lever and the second interconnecting lever, the operation of the auto speed control mechanism is prevented from being transmitted to the accelerator pedal.

Figure 11:
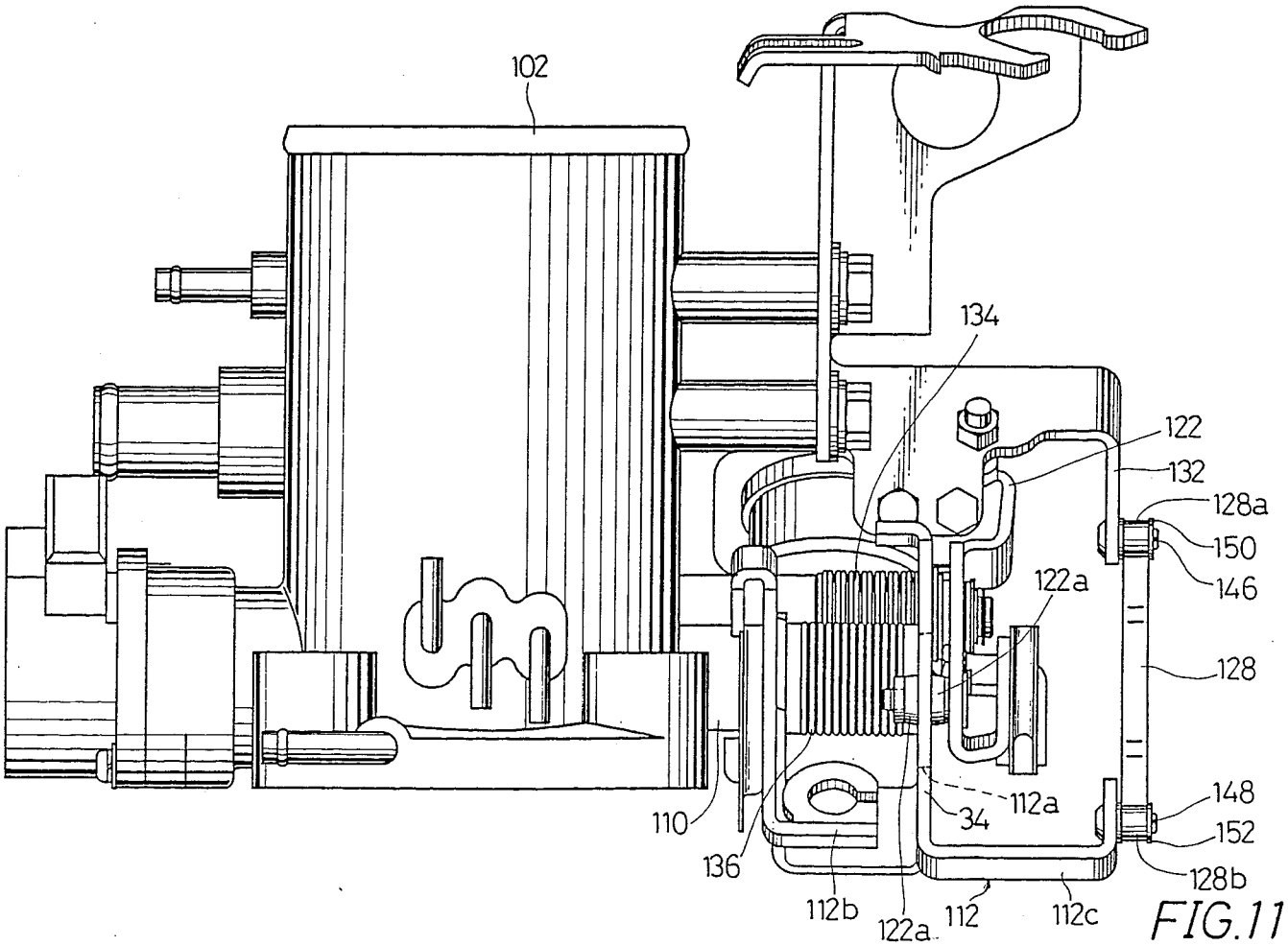
FIG. 11 is a plan view of the throttle body of a second preferred embodiment according to the present invention.
Figure 12:
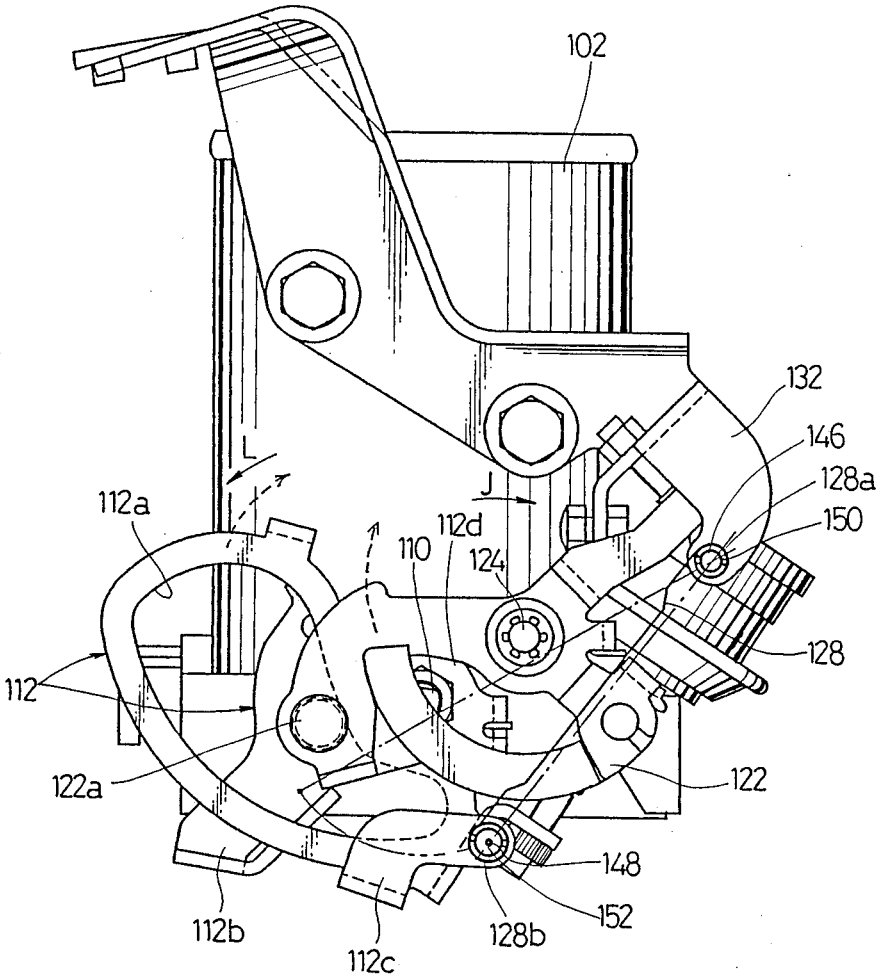
FIG. 12 is a side view of FIG. 11.

Referring next to FIGS. 11 and 12 which, show a second preferred embodiment of the present invention, an interconnecting lever 122 is provided with a roller 122*a*, and a throttle valve operating lever 112 is provided with a cam 112*a*. The roller 122*a* and the cam 112*a* are engaged with each other to transmit the rotation of the interconnecting lever 122 to the throttle valve operating lever 112 with a predetermined relation.

The throttle valve operating lever 112 is also provided with an auto cable connecting portion 112*b*, a first arm 112*c*, etc. adapted to be rotated together.

A pin 148 is fixed to the first arm 112*c*, and a pin 146 is fixed to a bracket 132 fixed to a suction cylinder 102. A spiral spring 128 is mounted between both the pins 146 and 148. The spiral spring 128 has opposite free ends 128*a* and 128*b* wound around the pins 146 and 148, respectively. The pins 146 and 148 are engaged at their ends with E-rings 150 and 152, respectively, thereby limiting movement of the free ends 128*a* and 128*b* in the axial direction of the pins 146 and 148.

The spiral spring 128 has a spring force for mutually approaching both the pins 146 and 148 and biasing the throttle valve operating lever 112 in a direction of arrow I shown in FIG. 12 (in the full closing direction).

A coil spring 134 is engaged with the interconnecting lever 122 to normally bias the interconnecting lever 122 in the counterclockwise direction as viewed in FIG. 12. Further, a coil spring 136 is engaged with the throttle valve operating lever 112 to normally bias the throttle valve operating lever 112 in the direction of arrow I shown in FIG. 12 in cooperation with the spiral spring 128. That is, the coil spring 136 assists the operation of the spiral spring 128.

In operation, when the accelerator pedal is operated to rotate the interconnecting lever 122 in a direction of arrow J shown in FIG. 12 against the biasing force of the coil spring 134, the throttle valve operating lever 112 is rotated in the direction counter to the direction of arrow I shown in FIG. 12 against the biasing forces of the coil spring 136 and the spiral spring 128. As a result, the coil spring 136 is twisted, and the spiral spring 128 is expanded because the distance between the pin 148 fixed to the first arm 112*c* and the pin 146 fixed to the bracket 132. As a torque of the spiral spring 128 is fixed with no relation to the degree of expansion thereof, a torque fluctuation of the throttle valve operating lever 112 is generated by the coil spring 136 only.

Figure 13:
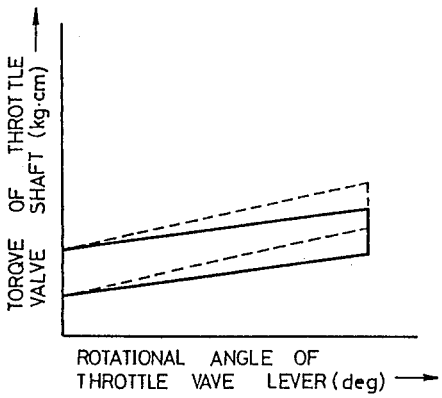
FIG. 13 is a graph showing the relation between a rotational angle of the throttle valve operating lever and a torque of the throttle valve shaft.
Figure 14:
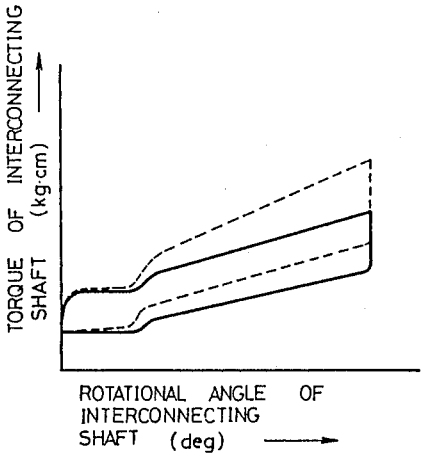
FIG. 14 is a graph showing the relation between a rotational angle of the interconnecting lever and a torque of the interconnecting shaft.
Figure 15:
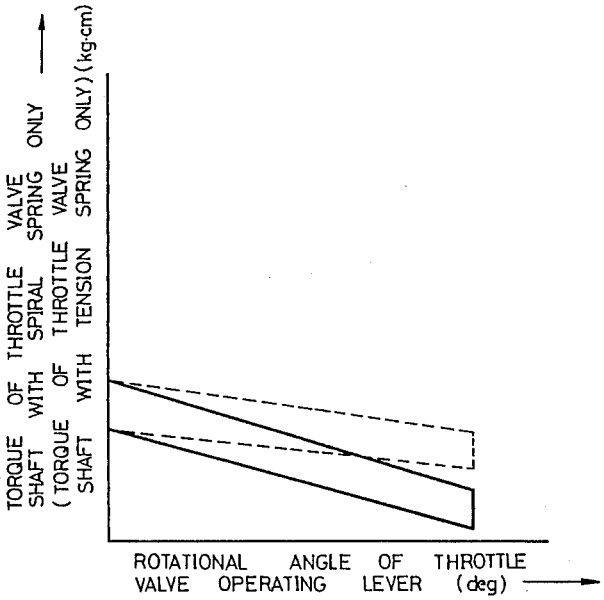
FIG. 15 is a graph showing the relation between a rotational angle of the throttle valve operating lever and a torque of the throttle valve shaft with a spiral spring only.

FIGS. 13, 14 and 15 show the relation between a rotational angle of the throttle valve operating lever 112 and a torque of the throttle valve shaft, the relation between a rotational angle of the interconnecting lever 122 and a torque of the interconnecting lever, and the relation between the rotational angle of the throttle valve operating lever 112 and the torque of the throttle valve shaft with the spiral spring 128 only. In FIGS. 13, 14 and 15, a dotted line indicates the preferred embodiment, while a dotted line indicates the prior art wherein a tension spring is used rather than the spiral spring. As apparent from these figures, the torques of the throttle valve shaft and the interconnecting shaft in the preferred embodiment are greatly lower than those in the prior art.

Figure 16:
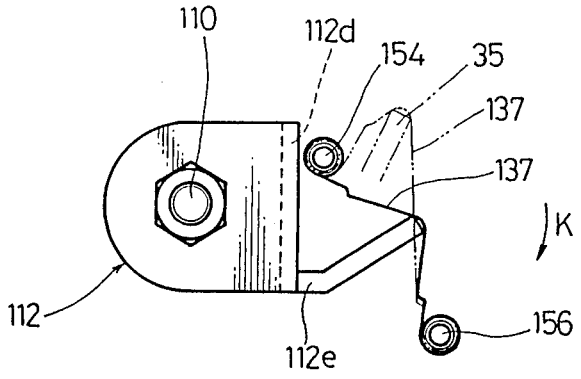
FIG. 16 is a schematic illustration of a third preferred embodiment according to the present invention.

Referring next to FIG. 16 which shows a third preferred embodiment modified from the second preferred embodiment, a spiral spring 137 is used instead of the coil spring 136 in the second preferred embodiment, and the other construction is similar to that in the second preferred embodiment.

As shown in FIG. 16, a second arm 112*e* projects outwardly from a plate portion 112*d* parallel to the throttle valve shaft 110 of the throttle valve operating lever 112. The full closed condition of the throttle valve is shown by a solid line in FIG. 16, wherein an outward end of the second arm 112*e* of the throttle valve operating lever 112 engages the side surface of the spiral spring 137, and is biased in a direction of arrow K by the spiral spring 137. Similar to the spiral spring 128, the spiral spring 137 has opposite free ends, and the free ends are wound around a pair of pins 154 and 156 projecting from the suction cylinder 102 in parallel to the throttle valve shaft 110. Although not shown, the pins 154 and 156 are engaged with E-rings for preventing axial movement of the spiral spring 137 in the same manner as the second preferred embodiment.

In operation, when the throttle valve operating lever 112 is rotated through the interconnecting lever 112, the spiral spring 137 is expanded by the outward end of the second arm 112*e* as shown by a dotted line in FIG. 16. Under the condition, a torque of the throttle valve operating lever 112 by the spiral spring 137 is fixed, and a torque by the spiral spring 128 is also fixed. Accordingly, a sum of these torques is fixed, and the constant torque is applied to the throttle valve operating lever.

Figure 17:
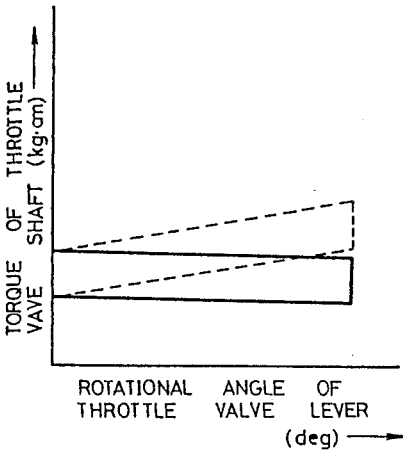
FIG. 17 is a graph showing the relation between a rotational angle of the throttle valve operating lever and a torque of the throttle valve shaft in the third preferred embodiment.
Figure 18:
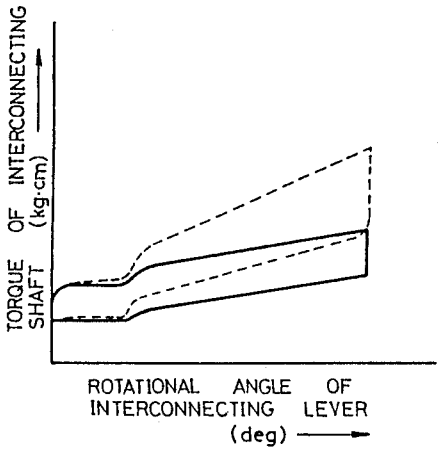
FIG. 18 is a graph showing the relation between a rotational angle of the interconnecting lever and a torque of the interconnecting shaft in the third preferred embodiment.

FIGS. 17 and 18 show the relation between the rotational angle of the throttle valve operating lever 112 and the torque of the throttle valve shaft and the relation between the rotational angle of the interconnecting lever 122 and the torque of the interconnecting shaft, respectively. In FIGS. 17 and 18, a solid line indicates the relations in the preferred embodiment, while a dotted line indicates the relations in the prior art. As apparent from these figures, the torques of the throttle valve operating lever 112 and the interconnecting lever 122 are lower than those in the prior art and in the second preferred embodiment.

Although the spiral springs 128 and 137 have opposite free ends in the above preferred embodiments, one end of each spiral spring may be fixed to the associated pin.

Figure 19:
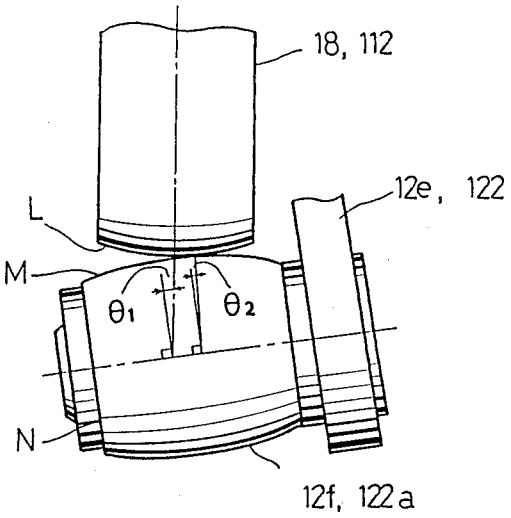
FIG. 19 is an enlarged view of the cam surface and the outer peripheral surface of the roller in the first to third preferred embodiments.
Figure 20:
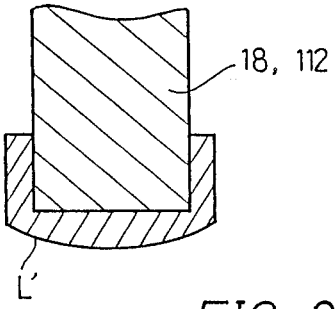
FIG. 20 is a sectional view of the cam surface in a modified form of FIG. 19.

FIG. 19 is an enlarged view illustrating a cross section L of the cam surfaces 18*d* and 112*a* and an outer peripheral surface M of the rollers 12*f* and 122*a* in the first to third preferred embodiments. The cross section L of the cam surface is convex, and the outer peripheral surface M is also convex in cross section, so as to reduce a contact area therebetween and thereby reduce the friction. Although the cam surface shown in FIG. 19 is integrally formed with the lever body, the cam surface L′ may be formed independently of the lever body as shown in FIG. 20.

Figure 21:
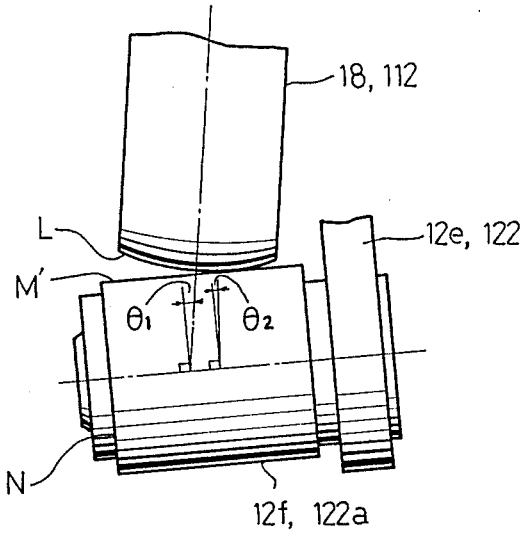
FIGS. 21 and 22 are modifications of FIG. 19.
Figure 22:
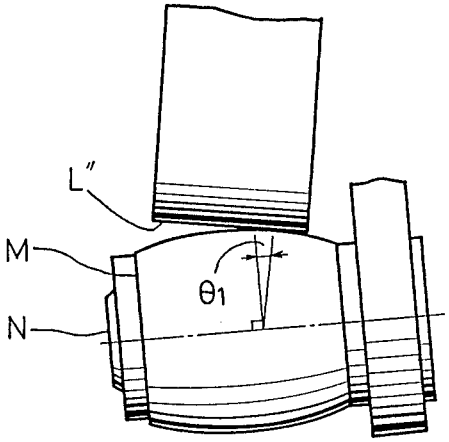
Figure 23:
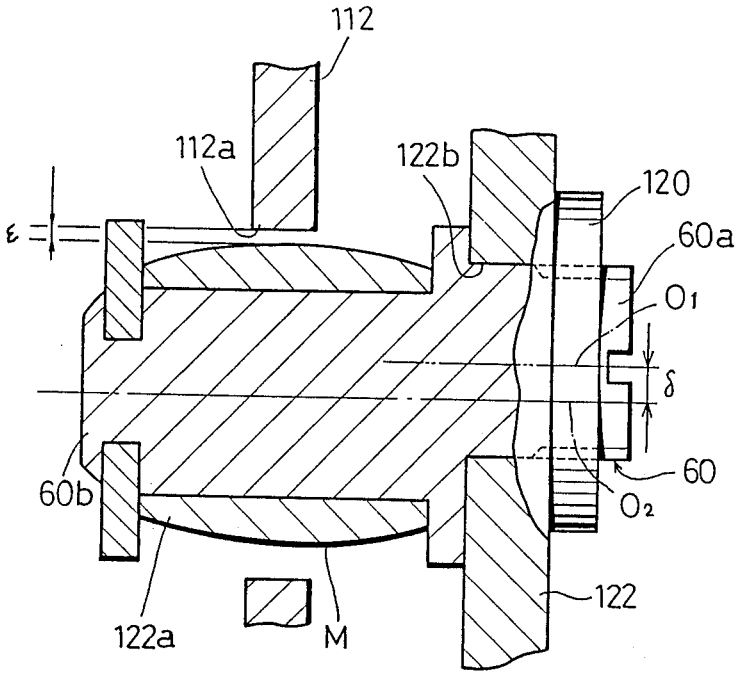
FIG. 23 is a sectional view of the mounting structure of the roller in the third preferred embodiment.

FIG. 21 shows a modified form wherein the outer peripheral surface M′ of the roller is straight in cross section. FIG. 22 shows a further modified form wherein the cam surface L″ is straight in cross section.

As shown in FIGS. 19, 21 and 22, when an angle defined by the plane of the cam plate and the shaft of the roller changes from a right angle because of any tolerance in manufacturing, an angle $\theta$ defined by a perpendicular at the contact point between the cam surface and the roller and a perpendicular to the roller shaft becomes $\theta 1$ when the cross section of the cam surface is straight as shown in FIG. 22, while the angle $\theta$ becomes $\theta 2$ smaller than $\theta 1$ when the cross section of the cam surface is convex.

A force applied at the contact point between the cam surface and the roller is partially imparted to an end surface N of the roller as a frictional force. The greater the angle $\theta$, the greater the frictional force.

Accordingly, when the cross section of the cam surface is convex, the angle $\theta$ is reduced to thereby reduce the frictional force to be applied to the end surface N of the roller. Accordingly, smooth relative movement of the roller and the cam may be achieved.

FIGS. 23 to 29 show a mounting structure of the roller 122*a* to the interconnecting lever 122 in the third preferred embodiment. The roller 122*a* is mounted through a mounting pin 60 to the interconnecting lever 122. The mounting pin 60 includes a columnar mounting portion 60*a* and a columnar shaft portion 60*b*. A center O1 of the mounting portion 60*a* is eccentric by $\delta$ from a center line O2 of the shaft portion 60*b*. The mounting portion 60*a* is rotatably inserted into a mounting hole 122*b* formed through the interconnecting lever 122, and is adapted to be fixed by a nut 120. Therefore, the position of the roller 122*a* may be adjusted by a maximum distance of $2\times\delta$ by loosening the nut 120 and rotating the mounting portion 60*a*.

The roller 122*a* mounted to the interconnecting lever 122 is engaged with the cam groove of the throttle valve operating lever 112, and the outer peripheral surface M of the roller 122*a* is adapted to contact the cam surface 112*a*. The contact point between the outer peripheral surface M of the roller 122*a* and the cam surface 112*a* is set to be located at a position P1 shown in FIG. 25 under the full closed condition of the throttle valve.

In the case that there is created a gap $\epsilon$ between the outer peripheral surface M of the roller 122*a* and the cam surface 112*a* in mounting the throttle valve because of any tolerance in manufacturing, the nut 120 fixed to the mounting portion 60*a* is loosened, and the mounting portion, 60*a* is rotated in a suitable direction to make the outer peripheral surface M of the roller-122*a* into contact with the cam surface 112*a*. Thereafter, the nut 120 is tightened again, thus eliminating the gap $\epsilon$.

Figure 25:
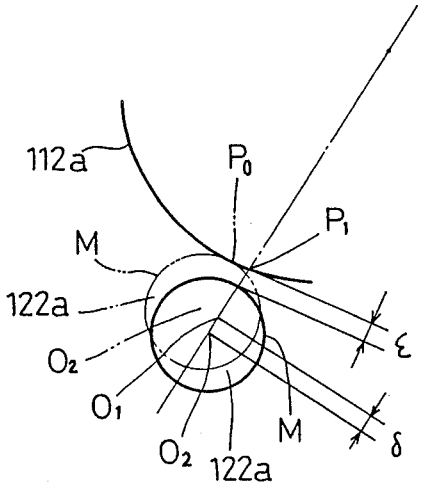
FIG. 25 is a schematic illustration of the method for adjusting the roller position according to the present invention.
Figure 26:
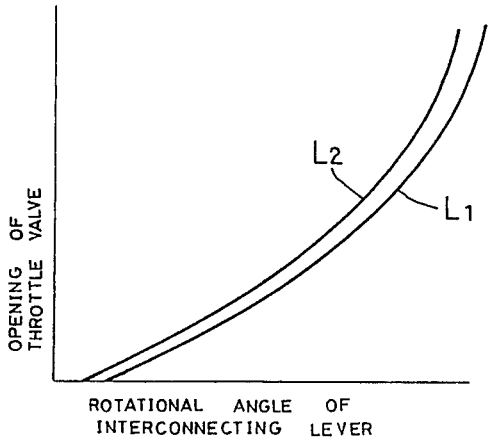
FIGS. 26 to 29 are characteristic graphs showing the relation between a rotational angle of the interconnecting lever and an opening of the throttle valve.
Figure 28:
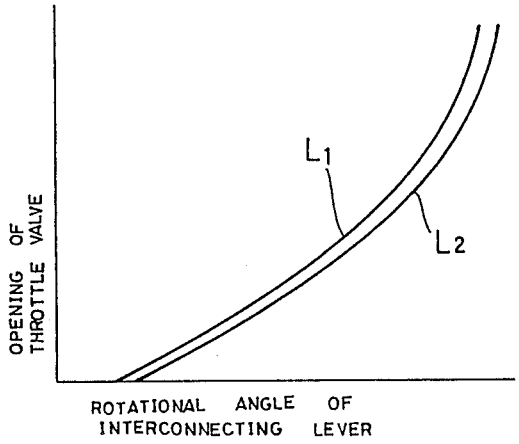

In this case, the roller 122*a* is eccentrically rotated about the axis O1 of the mounting portion 60*a*, and it is moved to the cam surface 112*a*. Therefore, it is unnecessary to move the interconnecting lever 122. As shown in FIG. 25, a distance of movement of the roller 122*a* along the cam surface 122*a* can be reduced to avoid a large slippage of an actual contact point P0 between the outer peripheral surface M and the cam surface 112*a* from the designed contact point P1. As shown in FIG. 26 or 28, the relation between the rotational angle of the interconnecting lever and the rotational angle of the throttle valve as designed is shown by a line L1, and the relation after adjusted is shown by a line L2. As apparent from these figures, the slippage between the lines L1 and L2 may be made small.

As previously mentioned, the maximum distance allowed to move the roller 122*a* perpendicular to the cam surface 112*a* in adjustment is $2\times\delta$ from the axis O1 of the mounting portion 60*a*. Therefore, by setting the value $\delta$ to be $\frac{1}{2}$ or more of a maximum value of the possible gap $\epsilon$, any values of the gap $\epsilon$ may be compensated.

Although the cam groove is formed in the throttle valve operating lever 112, and the roller 122*a* is mounted to the interconnecting lever 122 in this preferred embodiment, the cam groove may be formed in the interconnecting lever 122, and the roller may be mounted to the throttle valve operating lever 112. Further, the roller 122*a* may be replaced by a bearing such as a ball bearing.

Figure 24:
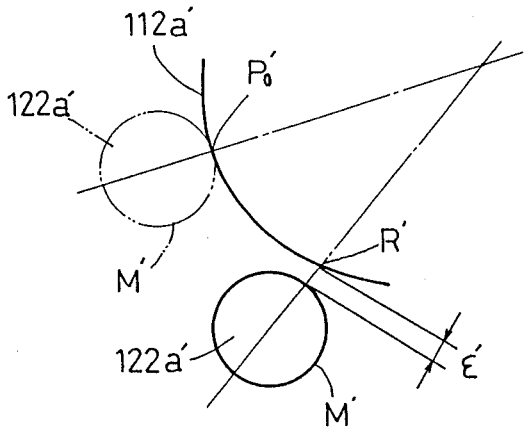
FIG. 24 is a schematic illustration of the conventional method for adjusting a roller position.
Figure 27:
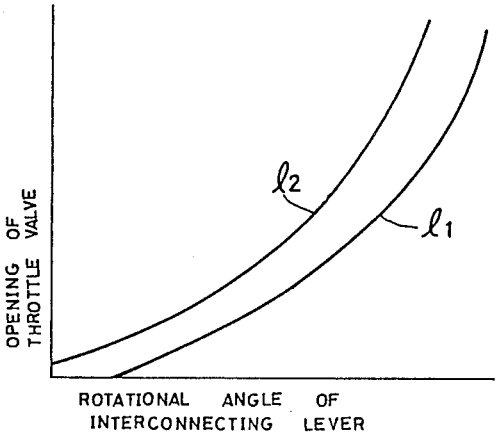
Figure 29:
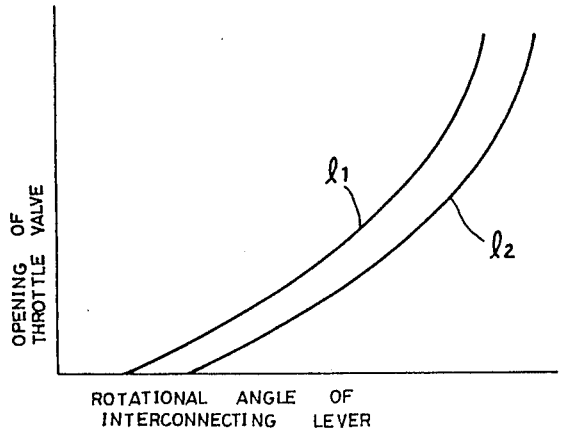

FIG. 24 shows a conventional adjusting method, wherein when a gap $\epsilon$ is generated at a designed contact point P1' between a roller 122*a*'and a cam surface 112*a*', an interconnecting shaft 122 for supporting the roller 122*a*'is rotated about its axis to bring the roller 122*a*'into contact with the cam surface 112*a*'at an actual contact point Po' under the valve open condition. As a result, the actual contact point Po' is largely slipped from the designed contact point P1', and the relation between the opening of the throttle valve and the opening of the interconnecting shaft is largely shifted from a designed line L1 to an actual line L2 as shown in FIGS. 27 and 29.

Figure 30:
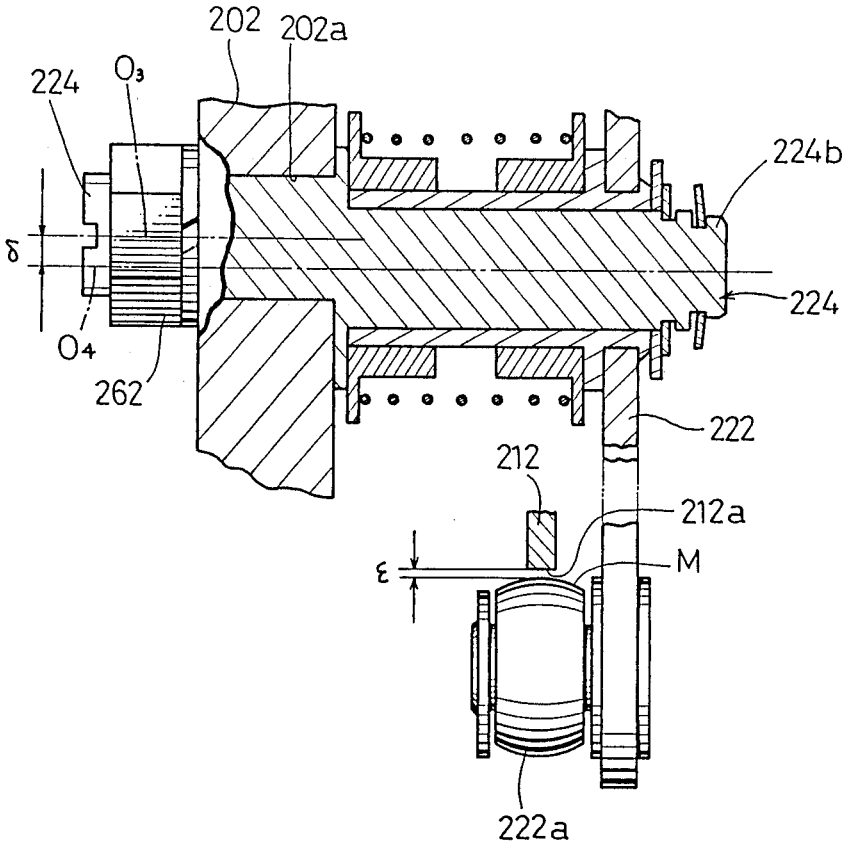
FIG. 30 is a sectional view of another preferred embodiment of the adjusting structure for contacting the roller with the cam surface under the full closed condition of the throttle valve.

Referring next to FIG. 30 which shows another adjusting structure for contacting a roller 222*a* with a cam surface 212*a* under the full closed condition of the throttle valve, an interconnecting lever 222 having the roller 222*a* is finely adjustably mounted to a suction cylinder 202. A columnar interconnecting shaft 224*b* is mounted through a columnar mounting portion 224*a* to the suction cylinder 202. The interconnecting shaft 224*b* has an axis O4 eccentric by $\delta$ from an axis O3 of the mounting portion 224*a*. The mounting portion 224*a* is rotatably inserted into a circular hole 202*a* formed through the suction cylinder 202, and is, adjustably fixed by a nut 262. Accordingly, when the nut 262 is loosened to rotate the mounting portion 224*a* in the hole 202*a*, the interconnecting shaft 224*b* is rotated about the axis O3 to allow the position of the interconnecting lever 222 to be finely adjusted within a range of $2\times\delta$.

Figure 31:
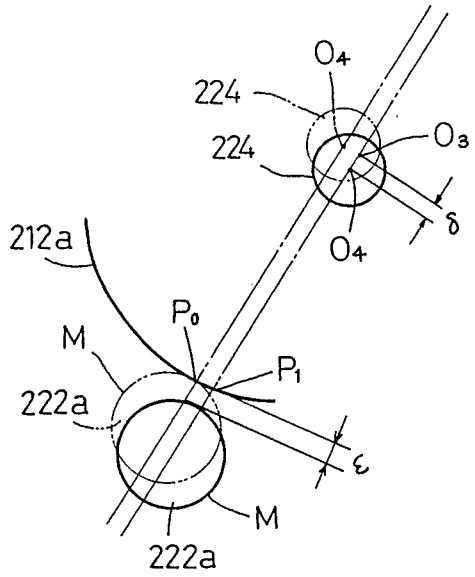
FIG. 31 is a schematic illustration of the essential part shown in FIG. 30.

As shown in FIG. 31, when there is generated a gap $\epsilon$ due to a tolerance or the like in manufacturing at a designed contact point P1 between the roller 222*a* and the cam surface 212*a*, the gap $\epsilon$ can be eliminated by rotating the mounting portion 224*a* and changing the position of the interconnecting shaft 224*b*. At this time, a distance between the actual contact point Po and the designed contact point P1 along the cam surface 212*a* can be made smaller than that in the conventional adjusting structure as shown in FIG. 24. Accordingly, the relation between the rotational angle of the interconnecting lever and the opening of the throttle valve is approximated to the relation shown in FIGS. 26 and 28.

Figure 32:
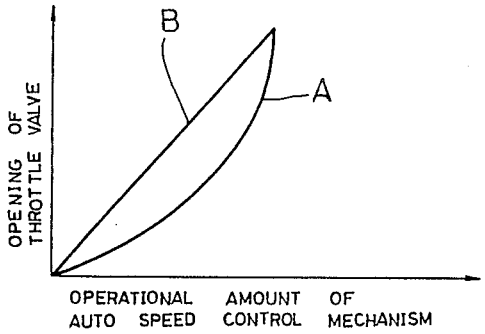
FIG. 32 is a graph showing the relation between an operational amount of the auto speed control mechanism and an opening of the throttle valve.

Referring back to the first preferred embodiment, when the accelerator cable is pulled, the first interconnecting lever 22 is rotated to cause the rotation of the second interconnecting lever 18. As a result, the throttle valve 8 is opened with the relation shown in FIG. 5 or 10. On the other hand, when the auto speed control mechanism is operated, the second interconnecting lever 18 only is rotated through the cable connected thereto from the auto speed control mechanism, without the rotation of the first interconnecting lever 22. As a result, the throttle valve 8 is opened with the relation shown in FIG. 5 or 10. Accordingly, the operation of the auto speed control mechanism has no influence upon the accelerator pedal or the like, and the operational amount of the auto speed control mechanism is coverted into an opening of the throttle valve with the relation shown in FIG. 5 or 10. That is, the relation shown by a line A in FIG. 32.

To the contrary, in the conventional suction cylinder device, the cable from the auto speed control mechanism is directly connected to the throttle valve operating lever. Alternatively, the cable is connected to the interconnecting lever, but the interconnecting lever is not separated into a first lever and a second lever. In the former case, the operational amount of the auto speed control mechanism is directly converted into the opening of the throttle valve 8 as shown by a line B in FIG. 32. That is, the control accuracy of the opening of the throttle valve is fixed regardless of the degree of the opening of the throttle valve according to the line B. To the contrary, according to the line A, the control accuracy of the opening of the throttle valve may be finer as the opening is smaller. In other words, the accuracy required by the auto speed control mechanism may be made more rough than that according to the line B.

In the latter case that the interconnecting lever is not separated into the first lever and the second lever, the operation of the auto speed control mechanism ,is transmitted through the interconnecting lever and the accelerator cable to the accelerator pedal, causing unnatural feeling to the operator. This problem is eliminated by the construction of the first preferred embodiment.

Figure 33:
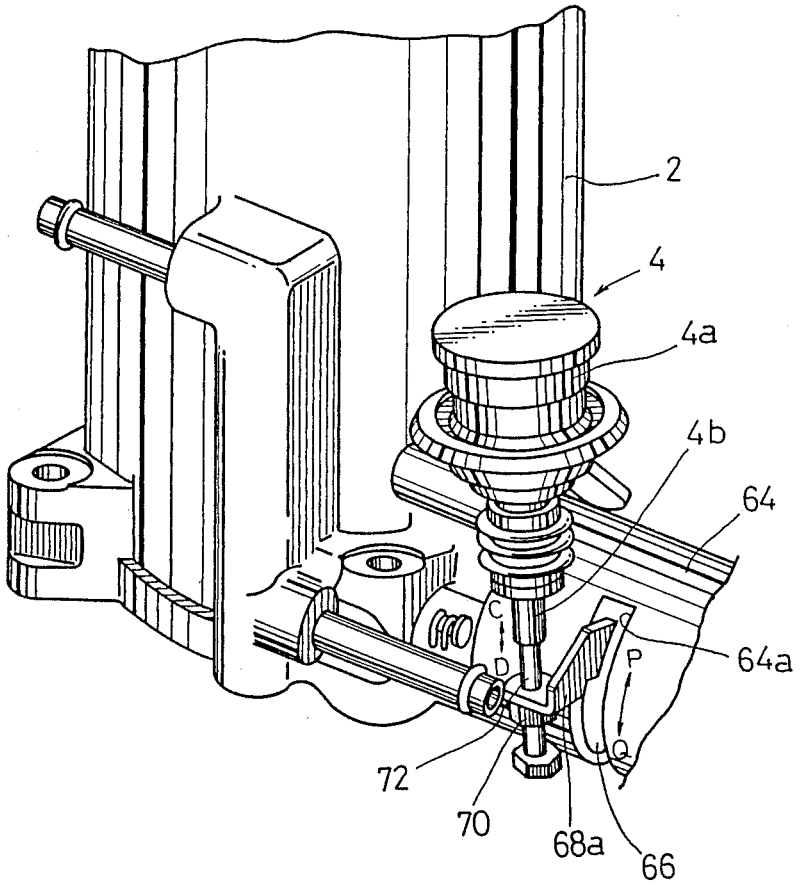
FIG. 33 is a perspective view of the mounting structure of the dash pot shown in FIG. 1.
Figure 34:
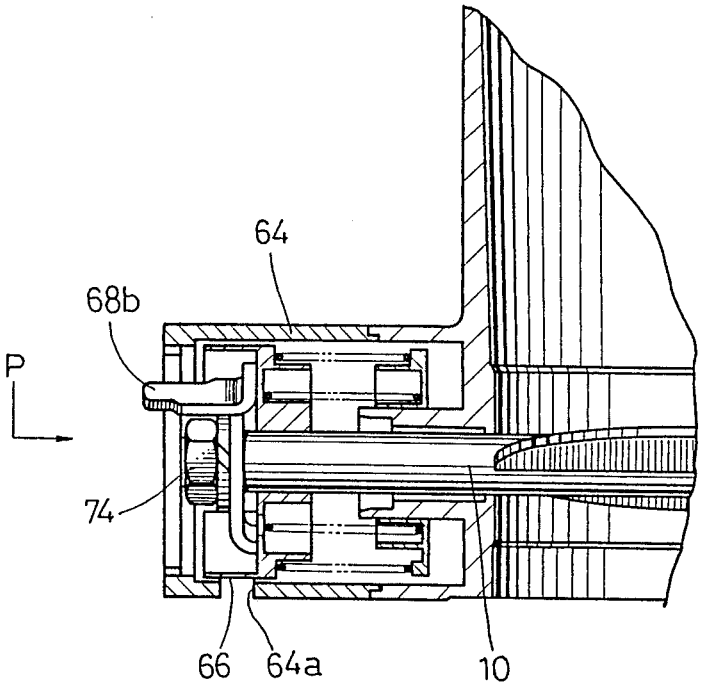
FIG. 34 is a vertical sectional view of FIG. 33.
Figure 35:
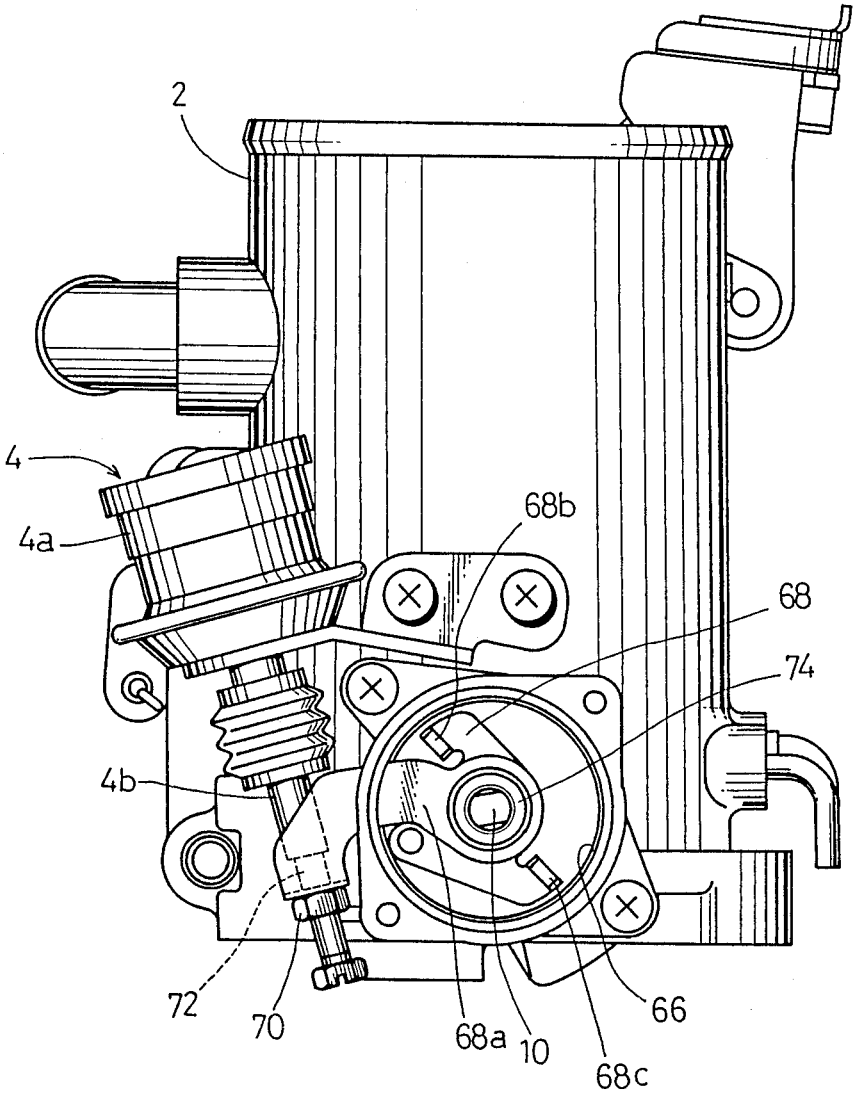
FIG. 35 is a side view of FIG. 33.

Referring next to FIGS. 33, 34 and 35 which show the mounting structure of the dash pot 4 and the throttle sensor 6 in the first preferred embodiment, the throttle valve shaft 10 extends through the suction cylinder 2 to the side opposite the throttle valve operating lever 12. A lever 68 is relatively irrotationally fixed to the shaft 10 at its end by a nut 74. The lever 68 has a dash pot engaging portion **68*a* extending perpendicular to the throttle valve shaft 10 and forked throttle sensor engaging portions 68*b* and 68*c* extending parallel to the shaft 10**.

A cylindrical cover 64 is provided around the throttle valve shaft 10, and is formed with an opening **64*a* for allowing extension of the dash pot engaging portion 68*a* therethrough. The dash pot engaging portion 68*a* is adapted to be rotated in the directions depicted by the double headed arrow P–Q in association with the rotation of the throttle valve shaft 10. A rod 72 is mounted to the dash pot engaging portion 68*a* by a nut 70 in such a manner that the rod 72 abuts against a rod 4*b* of the dash pot 4 under the full open condition of the throttle valve. The dash pot 4 includes a diaphragm chamber 4*a* for generating a certain resistance against retraction of the rod 4*b*, so that the throttle valve is prevented from being rapidly closed. A ring-like water resisting cover 66 is provided in the cylindrical cover 64 to normally close the opening 64*a* by the rotation with the dash pot engaging portion 68*a*, thereby preventing entry of water or dust from the opening 64*a***.

Figure 36:
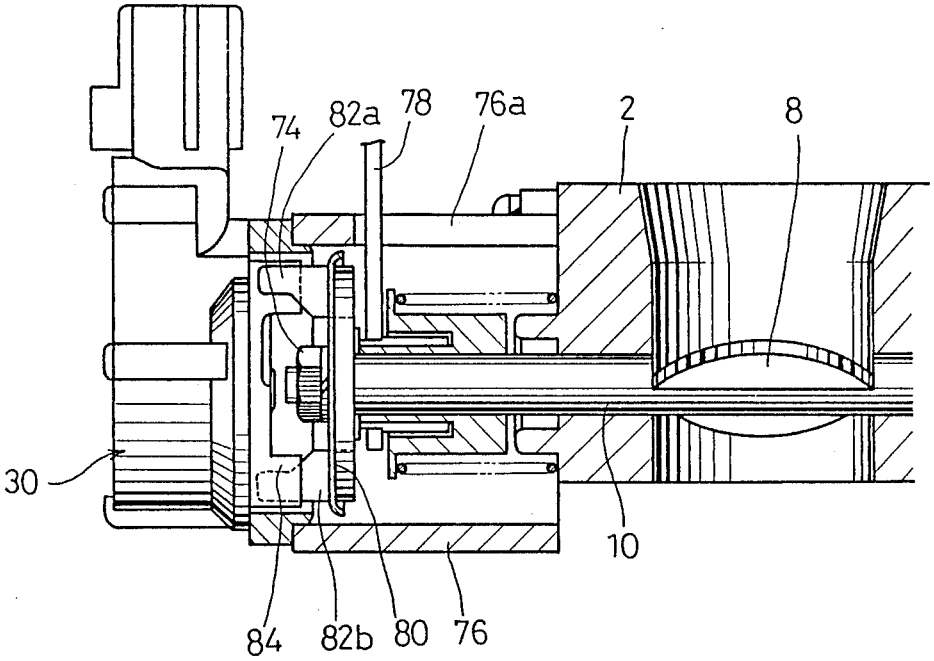
FIG. 36 is a vertical sectional view of the mounting structure of the throttle sensor similar to that shown in FIG. 1.

FIG. 36 shows an embodiment of the mounting structure of the throttle sensor. Referring to FIG. 36, a throttle positioner engaging member 78 is mounted to the throttle valve shaft 10 so as to be rotatable within a predetermined range. That is, the throttle positioner engaging member 78 is rotatable with the range of an opening **76*a* of a cylindrical case 76. Forked throttle sensor engaging members 82*a* and 82*b* are rotatably mounted to the end of the throttle valve shaft 10 by a nut 74. A disc-like cover 80 is also mounted to the end of the throttle valve shaft 10. The disc-like cover 80 is formed with two holes for inserting therethrough the throttle sensor engaging members 82*a* and 82*b*. The throttle sensor engaging members 82*a* and 82*b* are engaged with a rotatable substrate 84 provided in a throttle sensor 30. Accordingly, the substrate 84 is rotated in association with the rotation of the throttle valve shaft 10. The throttle sensor 30 has a structure such that electrical resistance is changed with a rotative angle of the substrate 84** to thereby detect an opening angle of the throttle valve.

As the throttle sensor 30 is normally covered by the disc-like cover 80, entry of water or dust from the opening **76*a* is prevented by the cover 80**.

In the above preferred embodiments shown, in FIGS. 33 to 36, each of the cylindrical covers 64 and 76 is provided with a drainage hole at a lowermost position of the throttle body, so as to quickly discharging the water having entered the same.

Having thus described the preferred embodiment of the invention, it should be understood that numerous structural modifications and adaptations may be made without departing from the spirit of the invention.

What is claimed is:

1. A throttle body for an internal combustion engine, comprising:

a suction passage for supplying a suction air to said internal combustion engine;

a throttle valve provided in said suction passage and fixed to a rotatable throttle valve shaft so as to adjust a quantity of said suction air;

an interconnecting lever rotatably mounted to an interconnecting shaft and adapted to be rotated by pulling an accelerator cable, said interconnecting lever having a cam groove;

a throttle valve operating lever having a cam follower engaging said cam groove and fixed to said throttle valve shaft, said throttle valve operating lever being rotated in predetermined relational association with rotation of said interconnecting lever to open and close said throttle valve; and a tension spring for normally biasing said throttle valve in a valve closing direction, said tension spring having one end or pivotal point fixed to a part fixed to said throttle body and the other end or operation point fixed to said throttle valve operating lever;

wherein said pivotal point and said operation point are located at positions such that a distance from said throttle valve shaft to a line connecting said pivotal point and said operation point is gradually reduced as said throttle valve is opened, and a connection point between said cam groove of said interconnecting lever and said cam follower of said throttle valve operating lever is approached to a line connecting said throttle valve shaft and said interconnecting shaft as said throttle valve is opened.

2. A throttle body for an internal combustion engine, comprising:

a suction passage for supplying a suction air to said internal combustion engine;

a throttle valve provided in said suction passage and fixed to a rotatable throttle valve shaft so as to adjust a quantity of said suction air;

an interconnecting lever rotatably mounted to an interconnecting shaft and adapted to be rotated by pulling an accelerator cable, said interconnecting lever having a cam groove;

a throttle valve operating lever having a cam follower engaging said cam groove and fixed to said throttle valve shaft, said throttle valve operating lever being rotated in predetermined relational association with rotation of said interconnecting lever to open and close said throttle valve; and a tension spring for normally biasing said interconnecting lever in a closing direction of said throttle valve, said tension spring having one end or pivotal point fixed to a part fixed to said throttle body and the other end or operation point fixed to said interconnecting lever;

wherein said pivotal point and said operation point are located at positions such that a distance from said interconnecting shaft to a line connecting said pivotal point and said operation point is gradually reduced as said throttle valve is opened, and a connection point between said cam groove of said interconnecting lever and said cam follower of said throttle valve operating lever is approached to a line connecting said throttle valve shaft and said interconnecting shaft as said throttle valve is opened.

3. A throttle body for an internal combustion engine, comprising:

a suction passage for supplying a suction air to said internal combustion engine;

a throttle valve provided in said suction passage and fixed to a rotatable throttle valve shaft so as to adjust a quantity of said suction air;

an interconnecting lever rotatably mounted to an interconnecting shaft and adapted to be rotated by pulling an accelerator cable;

a throttle valve operating lever mechanically connected to said interconnecting lever and fixed to said throttle valve shaft, said throttle valve operating lever being rotated in predetermined relational association with rotation of said interconnecting lever to open and close said throttle valve; and a spiral spring for normally biasing said throttle valve shaft in a closing direction of said throttle valve, said spiral spring having at least one free end and having a constant biasing force irrespective of an opening angle of 4. A throttle body for an internal combustion engine, comprising:

a suction passage for supplying a suction air to said internal combustion engine;

a throttle valve provided in said suction passage and fixed to a rotatable throttle valve shaft so as to adjust a quantity of said suction air;

an interconnecting lever rotatably mounted to an interconnecting shaft and adapted to be rotated by pulling an accelerator cable;

a throttle valve operating lever fixed to said throttle valve shaft, said throttle valve operating lever being rotated in association with rotation of said throttle valve shaft;

a cam groove formed on said interconnecting lever, said cam groove having a convex cross section; and a cam follower mounted to said throttle valve operating lever, said convex cross section reducing frictional force between said cam groove and said cam follower.

5. A throttle body for an internal combustion engine, comprising;

a suction passage for supplying a suction air to said internal combustion engine;

a throttle valve provided in said suction passage and fixed to a rotatable throttle valve shaft so as to adjust a quantity of said suction air;

an interconnecting lever rotatably mounted to an interconnecting shaft and adapted to be rotated by pulling an accelerator cable;

a throttle valve operating lever fixed to said throttle valve shaft, said throttle valve operating lever being rotated in association with rotation of said throttle valve shaft;

a cam groove formed on either of said interconnecting lever or said throttle valve operating lever; and a cam follower mounted to the other of said interconnecting lever or said throttle valve operating lever, said cam follower being formed with a columnar mounting portion having an axis eccentric from an axis of said cam follower, said mounting portion being rotatably inserted into a circular hole formed through said other lever, wherein when said mounting portion is rotated, a position of said cam follower is finely adjusted.

6. A throttle body for an internal combustion engine, comprising:

a suction passage for supplying a suction air to said internal combustion engine;

a throttle valve provided in said suction passage and fixed to a rotatable throttle valve shaft so as to adjust a quantity of said suction air;

an interconnecting shaft having a columnar base portion and a columnar residual portion, said base portion being eccentric from said residual portion and being rotatably inserted into a circular hole formed outside of said suction passage;

an interconnecting lever rotatably mounted to said residual portion of said interconnecting shaft and adapted to be rotated by pulling an accelerator cable;

a throttle valve operating lever fixed to said throttle valve shaft, said throttle valve operating lever being rotated in association with rotation of said throttle valve shaft;

a cam groove formed on either of said interconnecting lever or said throttle valve operating lever; and a cam follower mounted to the other of said interconnecting lever or said throttle valve operating lever, wherein when said base portion of said interconnecting shaft is rotated in said circular hole, a relative position of said cam groove and said cam follower is adjusted.

7. A throttle body for an internal combustion engine, comprising:

a suction passage for supplying a suction air to said internal combustion engine;

a throttle valve provided in said suction passage and fixed to a rotatable throttle valve shaft so as to adjust a quantity of said suction air;

a first interconnecting lever rotatably mounted to an interconnecting shaft and adapted to be rotated by pulling an accelerator cable;

a second interconnecting lever adapted to follow the rotation of said first interconnecting lever and adapted to be solely rotated by operating an auto speed control mechanism independently of said first interconnecting lever;

a throttle valve operating lever fixed to said throttle valve shaft, said throttle valve operating lever being rotated in association with rotation of said throttle valve shaft;

a cam groove formed on either of said first interconnecting lever or said throttle valve operating lever; and a cam follower mounted to the other of said first interconnecting lever or said throttle valve operating lever so as to be engaged with said cam groove.

* * * * *